US006398272B1

(12) United States Patent
Plummer et al.

(10) Patent No.: US 6,398,272 B1
(45) Date of Patent: Jun. 4, 2002

(54) FLEXIBLE DRAW LATCH

(75) Inventors: Richard M. Plummer, Kennett Square, PA (US); Andres A. Bolinas, Claymont, DE (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/557,589

(22) Filed: Apr. 22, 2000

(51) Int. Cl.[7] ..... E05C 19/10

(52) U.S. Cl. ..... 292/246; 292/292; 292/DIG. 49; 292/249

(58) Field of Search ..... 292/246, 249, 292/DIG. 16, DIG. 42, DIG. 49, DIG. 53

(56) References Cited

U.S. PATENT DOCUMENTS

| | | | | | |
|---|---|---|---|---|---|
| 357,240 | A | * | 2/1887 | Spielman | 292/249 |
| 3,479,701 | A | * | 11/1969 | Zerfoss | 292/247 X |
| 4,804,215 | A | | 2/1989 | Bisbing | |
| 4,828,298 | A | | 5/1989 | Bisbing | |
| 4,830,413 | A | * | 5/1989 | Bisbing | 292/247 |
| D324,165 | S | | 2/1992 | Bressler et al. | |
| D333,775 | S | | 3/1993 | Krape | |
| 6,076,865 | A | * | 6/2000 | Sokurenko et al. | 292/113 |

OTHER PUBLICATIONS

"Southco Handbook 2000," Southco, Inc., 1999, pp. 186–192.

"Southco Fasteners Handbook 35," Southco, Inc., 1986, pp. HH–2 to HH–7.

* cited by examiner

*Primary Examiner*—Teri Pham Luu
(74) *Attorney, Agent, or Firm*—Paul&Paul

(57) ABSTRACT

A flexible draw latch for use in securing two closure members together, including a keeper adapted to be affixed to one of the closure members, a mounting bracket adapted to be affixed to the other closure member, a flexible arm pivotally connected to the mounting bracket for pivotal movement relative to the mounting bracket, the flexible arm having a mounting portion with an annular groove disposed therein, and there being provided on the mounting bracket arcuate surface portions which are configured to correspond with the annular groove to facilitate guiding of the flexible arm throughout its pivot range.

15 Claims, 5 Drawing Sheets

FLEXIBLE DRAW LATCH

BACKGROUND OF THE INVENTION

1. Field of Invention

This invention relates generally to draw latches for use in securing two closure members together. More specifically, the present invention relates to draw latches of the flexible or elastic type.

2. Brief Description of the Related Art

Many types of draw latches are generally known in the art. One such type, an over-center draw latch, is disclosed in U.S. Pat. Nos. 3,181,095, issued May 4, 1965, 3,466,076, issued Sep. 9, 1969, Des. 324,165, issued Feb. 25, 1992, and Des. 333,775, issued Mar. 9, 1993, each of which is assigned to Southco, Inc. The latches disclosed in these patents essentially comprise a keeper and a one-piece part having three segments, namely a base segment, a locking segment, and an intermediate segment, wherein the intermediate segment is flexibly connected to the base and locking segments. When in a latched condition, the locking segment is detachably connected to the keeper and is in overlying relation to the keeper, the base segment, and the intermediate segment.

These latches were often considered desirable because they provided positive over-center latching, were lightweight, and also were inexpensive to manufacture. Furthermore, these latches were attractive in appearance. Typically, however, these latches were of a molded plastic construction and were incapable of use in situations where high loads were placed on the latch. Another disadvantage in these latches was the fact that considerable precision was required in the installation of the latch and the keeper in order for the latch to operate properly.

Flexible draw latches are also known in the art and have been used for many years. Perhaps the most simple example of a flexible draw latch comprises a mounting bracket, a rubber stretch arm affixed to the bracket, and a keeper. These flexible draw latches are typically used to secure loose-fitting hoods or covers on heavy machinery or mechanical equipment. In operation, the rubber stretch arm would be pulled up and into engagement with the keeper, whereby the elasticity of the rubber arm would keep the hood or cover secure. Although these latches were not very pleasing in appearance and did not provide the more positive over-center latching action, they were considered desirable because the flexibility of the rubber arm compensated for misalignment of the bracket and keeper during installation. Another advantage of these flexible draw latches was that the load capability of the latch could be varied, within a range, by simply increasing or decreasing the distance between the bracket and the keeper and, thus, the tension on the rubber stretch arm. In high load situations, this type of latch became impractical, however, because of the difficulty in stretching the heavy-duty rubber arm required in such situations.

Another type of flexible draw latch is also known which was primarily developed to overcome the disadvantages of the above-mentioned flexible latch by providing a lever handle to assist in stretching the rubber arm. Essentially, these lever-assisted flexible draw latches comprise a bracket, a rubber stretch arm, a lever handle and a keeper. The rubber stretch arm is connected at one end to the bracket and connected at the other end to the lever at a point intermediate the ends of the lever. To operate the latch, the lever handle was inserted in the keeper and pivoted to stretch the rubber arm and then seating to secure the latch with a positive over-center action. Despite its advantages over the previous flexible draw latches, however, these lever assisted latches were considered unsightly and their use was essentially limited to high load situations where heavy-duty latches are required.

Other flexible draw latches, disclosed in U.S. Pat. Nos. 4,828,298 issued May 9, 1989, and 4,804,215 issued Feb. 14, 1989, and being assigned to Southco, Inc., are known which provide a simple draw-pull latch for use in securing two closure members together which has the advantages of a flexible locking member in an aesthetically pleasing latch which is inexpensive to manufacture, easy to use, and has a wide variety of practical applications. A flexible draw latch is shown in U.S. Patent D 333,775, issued on Mar. 9, 1993. The latch shown in the '775 patent provides a mounting bracket, a flexible arm, and a keeper. At times, the arm can be interfered with by the mounting bracket which holds it.

A need exists for a flexible draw latch which has a smooth operation for facilitating the pivotal movement of the flexible arm relative to the mounting bracket. The present invention provides a flexible draw latch which has improved operating features and which has advantages of being easy to use, install and to construct.

SUMMARY OF THE INVENTION

The present invention comprises a flexible draw latch for use in securing two closure members together, comprising a keeper adapted to be affixed to one of the members, a mounting bracket adapted to be affixed to the other member, and a flexible arm pivotally held by the mounting bracket. In operation, the arm is pivotally maintained at one end thereof by the mounting bracket, and swings from an open relaxed position toward the keeper, and is flexed to connect with the keeper.

The flexible draw latch features a guide which preferably can comprise an annular groove disposed in the mounting portion of the arm. The mounting bracket, likewise, is configured with a pair of mounting bosses with which the annular groove of the arm mates for correspondence in order to facilitate the smooth pivoting of the latch arm and to provide a hold-open feature.

Accordingly, it is a primary object of the present invention to provide a novel flexible draw latch.

It is another object of the present invention to provide a draw latch having a flexible arm.

It is a further object of the invention to accomplish the above objects in a flexible draw latch operated by stretching a flexible arm over a keeper for latching engagement therewith.

It is a further object of the invention to provide a flexible draw latch having variable load capabilities.

It is a further object of the invention to accomplish the above objects by providing a flexible draw latch with improved operating and aligning features.

It is a further object of the invention to accomplish the above objects where a flexible draw latch is operated by stretching a flexible arm over a keeper for latching engagement therewith.

It is yet a further object to accomplish the above objects where the draw latch is provided with a smoothly pivotable arm.

It is another object of the invention to provide a flexible draw latch wherein a groove provided in the arm is used to facilitate smooth pivoting of the latch by mating with at least one boss of the mounting bracket.

These and other objects of the invention will become apparent upon a reading of the following detailed description of the invention with reference to the drawings, and the appended claims.

DETAILED DESCRIPTION OF THE INVENTION

Figure 1:
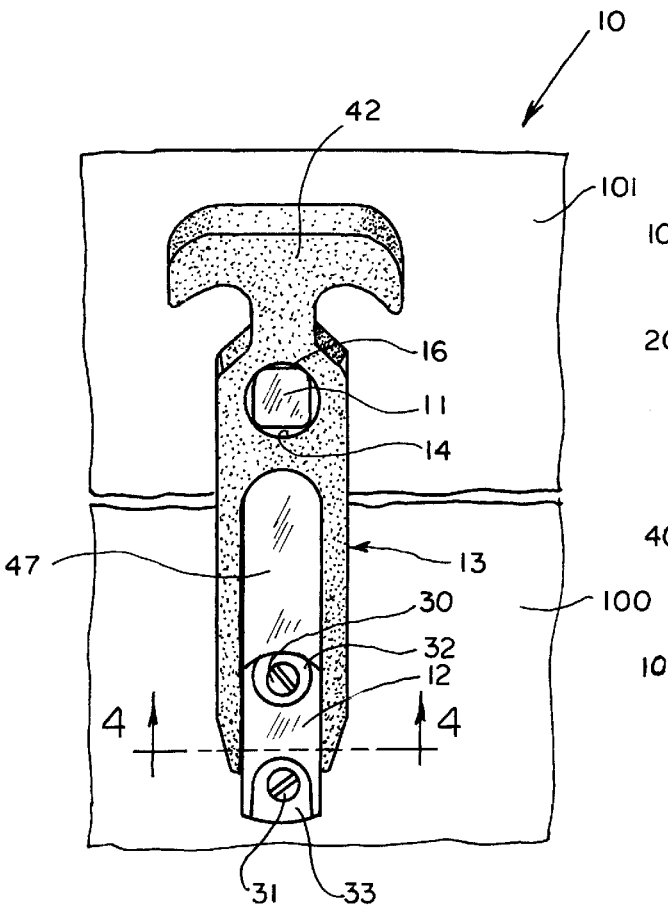
FIG. 1 is a front elevation view of a flexible draw latch according to the present invention, as shown securing a closure panel member to a corresponding frame.
Figure 2:
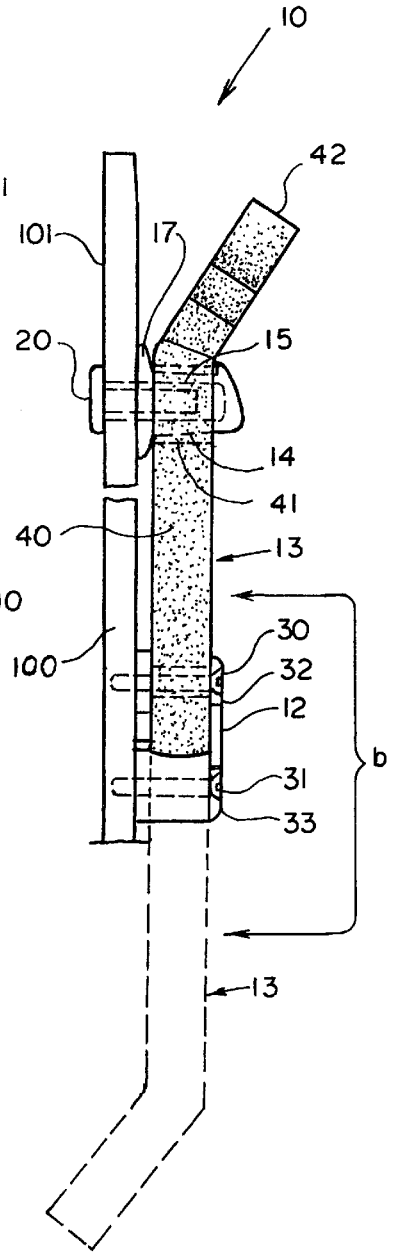
FIG. 2 is a right side elevation view of the draw latch shown in FIG. 1.

Reference now being made to FIG. 1, a flexible draw latch 10 according to the present invention is shown comprising a keeper 11, a mounting bracket 12, and a flexible arm member 13. Preferably, the flexible arm is comprised of a flexible, resilient material, such as, for example, an elastomer. Examples of suitable elastomers include natural rubber and thermoplastic elastomer (TPE). As seen in FIGS. 1 and 2, the keeper 11 is adapted for being affixed to a closure member, such, for example, the closure panel 100, and preferably comprises a substantially cylindrical body member 14 having a bore 15 disposed therein for mounting and a retaining lip 16 at the end thereof. A flange 17 is provided at the cylindrical member at the end thereof opposite the lip 16.

As shown best in FIG. 2, the keeper 11 is affixed to a member, such as, for example, a corresponding frame or panel 100 with a screw 20 or other suitable fastener disposed within the bore 15 of cylindrical body portion 14. The flange 17 facilitates the retention of the keeper 11 and the distribution of the force load across the panel 100 or frame 101.

Figure 3:
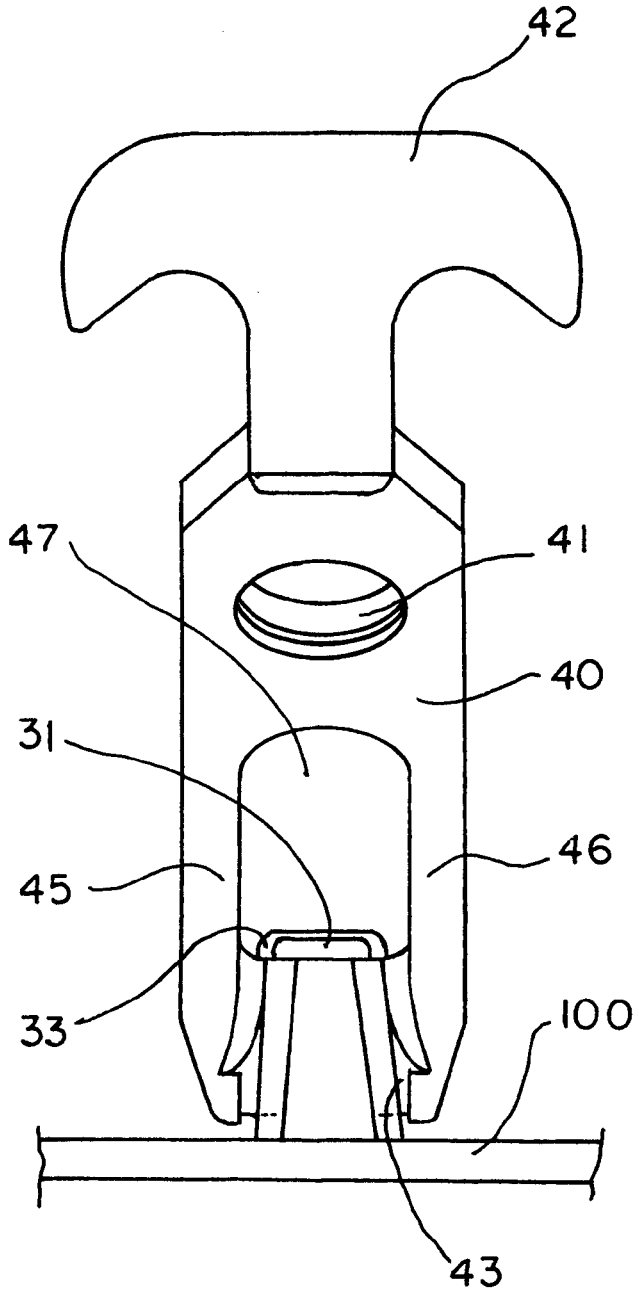
FIG. 3 is a perspective view of the present invention, shown mounted to a closure panel member, illustrated in the unlatched condition.
Figure 5:
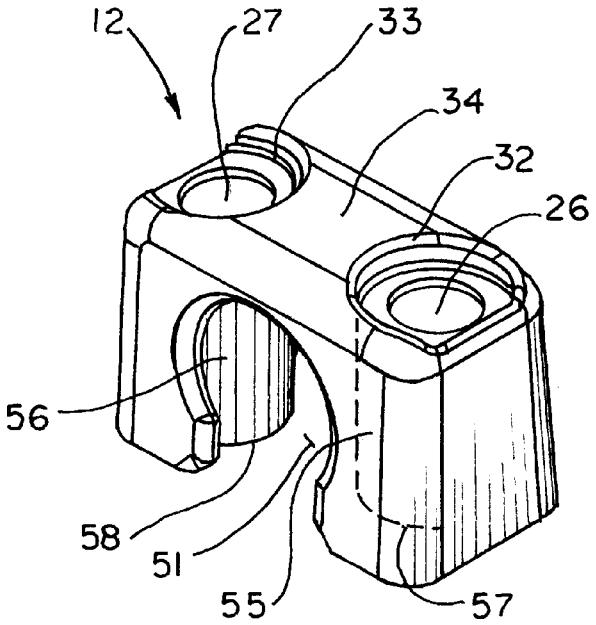
FIG. 5 is a perspective, separate view of the mounting bracket of the flexible draw latch shown in FIGS. 1–4.

The mounting bracket 12 is shown in a separate view in FIG. 5. The mounting bracket 12 has mounting means for attachment of the mounting bracket 12 to a panel member, such as, for example, the closure panel 100 shown in FIGS. 1–3. The mounting means can comprise bores 26, 27 provided in the bracket 12 and through which fastening members, such as the screws 30, 31 as shown in FIG. 1, extend to connect with the panel 100. Alternately, while not shown, it is conceivable that fastening members other than screws can be employed. In addition, while not shown, fastening members can comprise threaded bolts which can extend through the panel 100 and be secured with a matingly associated nut. As best shown in FIG. 5, the mounting member 12 is provided with wells 32, 33 which are disposed in the upper surface 34 to accommodate the heads of the corresponding respective fastening members, such as the screws 30, 31.

Figure 4:
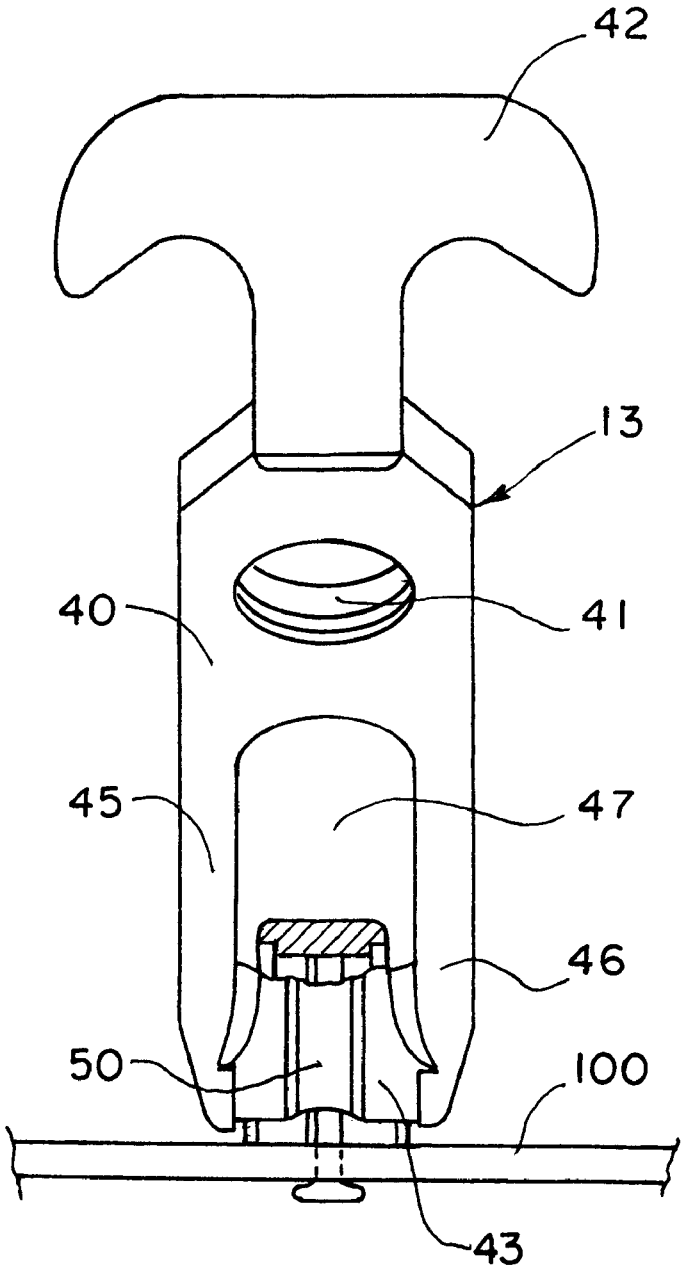
FIG. 4 is a perspective view of the present invention, shown mounted to a closure panel member, illustrated in the unlatched condition with the mounting bracket shown in sectional view taken along line 4—4 of FIG. 1.

The flexible arm member 13 is shown in FIG. 4 having a body portion 40 with a first aperture 41 therein, a lifting portion 42 disposed at one end thereof, and a mounting portion 43. The body portion 40 further has a pair of legs 45, 46 which connect with the mounting portion 43 to define a second aperture 47.

Figure 6:
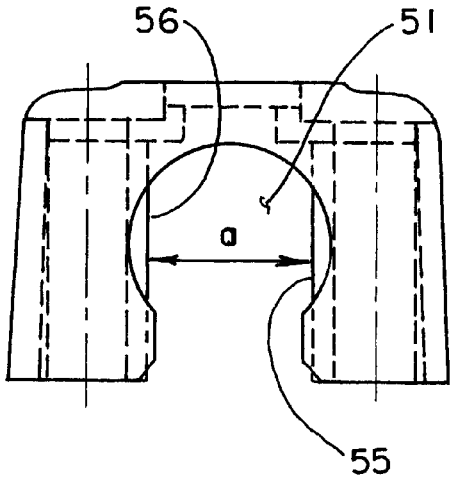
FIG. 6 is right side elevation, separate view of the mounting bracket of FIG. 5, the left side being a mirror image of the right.

Referring again to FIGS. 5 and 6, the mounting bracket 12 is shown comprising a generally u-shaped configuration. The mounting bracket 12 further has a space 51 therein, through which, as shown in FIG. 4, the mounting portion 43 of the flexible arm 13 passes. The mounting bracket 12 retains the flexible arm 13 of the latch 10 on the closure panel 100. The latch arm 13 is therefore able to pivot relative to the mounting bracket 12.

Guide means is provided for facilitating the pivoting of the flexible arm member 13 throughout its pivot range. The guide means is shown in FIG. 4 comprising an annular groove 50 disposed in the mounting portion 43 of the arm 13. Preferably, as shown, the annular groove 50 is tapered from each edge thereof to its center, forming a generally concave configuration. The guide means further is shown comprising groove-engaging means disposed on said mounting bracket 12 which is matingly associated for contact with the annular groove 50 of the flexible arm 13. The groove-engaging means preferably comprises an arcuate surface portion, such as the arcuate surfaces 55, 56 disposed on opposite sides of the mounting bracket space 51. Preferably, posts or bosses 57, 58 can be employed on which the arcuate surfaces 55, 56 can be provided. The bosses 57, 58 preferably can have the mounting bores 26, 27 disposed therein. Preferably, the radius of curvature of the arcuate surfaces 55, 56 is configured for mating association with the annular groove 50 of the arm mounting portion 43. The arcuate surfaces 55, 56 are spaced apart to narrow the opening 51 at a zone between the bosses 57, 58, the dimension of the narrowing defined by the distance between the bosses 57, 58 in this zone being represented by the double arrow "a" in FIG. 6. The groove 50 of the mounting portion 43 is held between the bosses 57, 58 and is guided by the arcuate surfaces 55, 56 throughout its pivot range. The flexible arm 13 has a pivot range which permits the arm 13 to pivot from its fully open position shown by broken lines in FIG. 2, to its latched position where it is secured to a keeper 11.

While the bosses 57, 58 are shown having bores 26, 27 disposed therein, respectively, which extend through the upper surface 34 of the mounting bracket 12, it will be understood that bores 26, 27 can also be blind such that the bores end below the top surface 34 of the mounting bracket and are thus not visible. For example, while not shown, it will be understood that, with the blind bores, screws can be inserted into the bores 26, 27 such that the screw heads are positioned on the reverse side of the closure panel 100, relative to the side of the panel 100 on which the mounting bracket 12 is provided, in order to secure the mounting bracket 12 to the panel 100.

The operation of the flexible draw latch will now be described with reference being had to the drawing Figures. First, as seen in FIG. 2, in order to secure the latch, the latch arm 13 is moved from its unlatched position by pivoting in the direction of double arrow "b" so that the first aperture 41 aligns with the keeper 11. The flexible arm member 13 preferably is stretched and the first aperture 41 drawn over the lip 16 of the keeper 11 and onto the keeper body 14. Likewise, unlatching is accomplished by pulling the arm 13 to slightly stretch the arm 13 to allow the aperture 41 to clear the lip 16 of the keeper 11. The arm 13 may then be pivotally moved off of the keeper 11.

It can be seen from the above specification, that the latch of the present invention, due to the presence of a flexible, resilient locking member, provides all of the advantages associated with flexible draw latches. For example, the flexibility of the locking member insures a positive latching action, even if the mounting bracket and the keeper are not in precise alignment, and thus compensates for misalignment of the bracket and keeper during installation. In addition, the load or tension generated by the locking member can be varied, within a particular range, by simply increasing or decreasing the distance between the mounting bracket and the keeper to provide a lesser or greater degree of stretch in the locking member when the latch is closed. Of course, if the distance is too short the locking member will not properly engage the keeper and the latch will be ineffective. Likewise, if the distance is too large, the latch will tend to release spontaneously because the stretch capabilities of the locking member have been exceeded.

The minimum diameter of the mounting portion 43 at the bottom of the groove 50 and/or the dimensions of the groove 50 are selected such that there is frictional engagement between the arcuate surfaces 55 and 56 of the bosses 57 and 58 and the concave surface of the groove 50. This frictional engagement provides a hold-open feature by preventing uncontrolled pivotal movement of the arm 13 when the arm 13 is unlatched and not being actively moved by a user.

The function of the groove 50 may optionally be enhanced by a pair of spaced-apart, annular projecting ridges provided on either side of the groove 50. These annular ridges would project radially outward relative to the remaining portions of the mounting portion 43. Also, these annular projecting ridges may in whole or in part define the annular groove 50.

In the illustrated embodiment, the lifting portion 42 is in the form of a T-shaped handle which is integrally made with the remaining portions of the arm 13. The lifting portion 42 provides a means for allowing a user to grasp and manipulate the arm 13. For example, the user may grasp the lifting portion 42 to stretch and pivotally move the arm 13.

Figure 7:
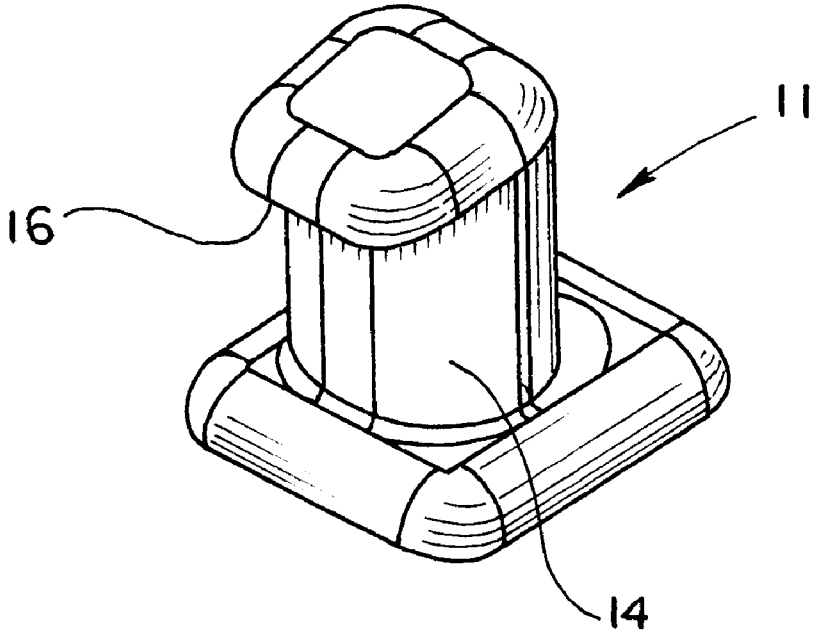
FIG. 7 is a perspective view showing the keeper of the flexible draw latch of the present invention in isolation.

The keeper illustrated in FIG. 7 has a blind bore for engagement by a screw inserted from the side of the panel 101 opposite the side on which the keeper 11 is mounted. Alternatively, the keeper 11 may be provided with a countersunk through hole similar to bores 26 and 27, and the keeper may be secured to closure member 101 by a screw inserted through the top of the keeper such that the head of the screw is positioned near the end of the keeper having the lip 16.

Preferred forms of the invention have been described and illustrated herein for purposes of illustration only and not for purposes of limitation, and various modifications or alternatives may suggest themselves to those skilled in the art, all of which are intended to be within the spirit and scope of the present invention as defined in the appended claims.

What is claimed is:

1. A flexible draw latch for use in securing two closure members together, comprising:

(a) a keeper adapted to be affixed to a first closure member;

(b) a mounting bracket adapted to be affixed to a second closure member;

(c) a flexible arm pivotally connected to said mounting bracket and adapted for pivoting to selectively detachably engage said keeper, wherein said arm has a mounting portion at one end thereof which is maintained in a pivotal relation with said mounting bracket; and (d) guide means for facilitating pivoting of said flexible arm, wherein said guide means comprises an annular groove disposed in said mounting portion of said arm, and a pair of arcuate surfaces disposed on said mounting bracket.

2. The flexible draw latch of claim 1, wherein said flexible arm comprises a body portion having a first aperture therein, a lifting portion, and a mounting portion, wherein said guide means comprises an annular groove disposed in said mounting portion, and wherein said mounting bracket comprises at least a portion which extends into said annular groove to facilitate positioning of said flexible arm mounting portion relative to said mounting bracket.

3. The flexible draw latch of claim 2, wherein said at least a portion of said mounting bracket which extends into said annular groove frictionally engages said annular groove to form a hold-open feature for preventing uncontrolled pivotal movement of said flexible arm when said flexible arm is unlatched.

4. The flexible draw latch of claim 2, wherein said flexible arm is stretched to an elongate condition and then contracts when said flexible arm is in a fully closed position.

5. The flexible draw latch of claim 1, wherein said annular groove has a concave configuration.

6. The flexible draw latch of claim 5, wherein said mounting bracket has matingly configured arcuate portions disposed on each side of said annular groove of said mounting portion, and wherein said arcuate portions correspond to the concavity of said annular groove.

7. The flexible draw latch of claim 1, wherein said annular groove has an arcuate configuration, and wherein said mounting bracket has matingly configured arcuate portions which are located for disposition on opposite sides of the mounting portion of said flexible arm, said annular groove being disposed to engage with said matingly configured arcuate portions of said mounting bracket.

8. The flexible draw latch of claim 1, wherein said flexible arm comprises a body portion having a first aperture therein, a lifting portion, and said flexible arm further comprising a second aperture formed in said body and being defined in part by said mounting portion, wherein said mounting bracket comprises a substantially u-shaped member adapted to be mounted to the second closure member and wherein said mounting portion of said flexible arm extends through said substantially u-shaped member and is pivotally secured thereby when said mounting bracket is installed on the second closure member.

9. The flexible draw latch of claim 1, wherein said flexible arm comprises an elastomeric material.

10. The flexible draw latch of claim 9, wherein said elastomeric material is thermoplastic elastomer.

11. The flexible draw latch of claim 1, wherein said mounting bracket comprises arcuate surfaces which extend into said annular groove to facilitate guiding of said flexible arm throughout a pivot range relative to said mounting bracket.

12. A flexible draw latch for use in securing two closure members together, comprising:

(a) a keeper adapted to be affixed to a first closure member;

(b) a mounting bracket adapted to be affixed to a second closure member;

(c) a flexible arm pivotally connected to said mounting bracket; and (d) guide means for facilitating pivoting of said flexible arm;

(e) wherein said flexible arm has a lifting portion at one end thereof and a mounting portion disposed at the other end thereof, and wherein said mounting bracket has an opening therethrough through which said mounting portion extends, said mounting portion having an annular groove disposed therein, said annular groove being tapered to form a substantially concave configuration; and (f) wherein said mounting bracket has a pair of posts, each post being disposed adjacent to said opening and on opposite sides thereof and on opposite sides of the mounting portion of said flexible arm so that said posts are spaced apart from one another to define a pathway therebetween which narrows the opening through said mounting bracket.

13. The flexible draw latch of claim 12, wherein said flexible arm comprises an elastomeric material.

14. The flexible draw latch of claim 13, wherein said elastomeric material is thermoplastic elastomer.

15. A flexible draw latch for use in securing two closure members together, comprising:

(a) a keeper adapted to be affixed to a first closure member;

(b) a mounting bracket adapted to be affixed to a second closure member;

(c) a flexible arm pivotally connected to said mounting bracket and adapted for pivoting to selectively detachably engage said keeper, wherein said arm has a mounting portion at one end thereof which is maintained in a pivotal relation with said mounting bracket; and (d) guide means for facilitating pivoting of said flexible arm, wherein said guide means comprises a zone which is cross-sectionally narrower over a portion of the length of said mounting portion and a portion of said mounting bracket which extends into said zone for facilitating the pivotal movement of said arm relative to said mounting bracket.

* * * * *